United States Patent [19]

Cook et al.

[11] 4,210,349

[45] Jul. 1, 1980

[54] DEVICE FOR HOLDING A DOOR FIRMLY CLOSED

[75] Inventors: Sanford L. Cook, Ocean; Joseph N. Villa, Freehold, both of N.J.

[73] Assignee: Standard Keil Hardware Manufacturing Co., Allenwood, N.J.

[21] Appl. No.: 973,263

[22] Filed: Dec. 26, 1978

[51] Int. Cl.[2] ..... E05C 19/02

[52] U.S. Cl. ..... 292/78; 16/84; 16/DIG. 32; 292/201; 292/DIG. 49; 292/DIG. 71

[58] Field of Search ..... 16/80, 71, 72, 78, 84, 16/85, DIG. 7, DIG. 17, DIG. 32, 82; 292/78, 79, 201, DIG. 49, DIG. 71; 49/394

[56] References Cited

U.S. PATENT DOCUMENTS

| | | | |
|---|---|---|---|
| 2,394,878 | 2/1946 | Slopa | 292/79 |
| 2,598,958 | 6/1952 | Wood | 16/80 X |
| 2,601,983 | 7/1952 | Schoelkopf | 292/78 |
| 2,606,052 | 8/1952 | Soreng et al. | 292/DIG. 71 |
| 2,833,578 | 5/1958 | Burke | 292/78 X |
| 3,659,886 | 5/1972 | Andrews | 292/78 |
| 3,825,215 | 7/1974 | Borglum | 16/84 X |
| 3,905,626 | 9/1975 | Myers | 292/78 X |
| 4,056,276 | 11/1977 | Jarvis | 292/DIG. 49 X |

FOREIGN PATENT DOCUMENTS

| | | | |
|---|---|---|---|
| 1224637 | 9/1966 | Fed. Rep. of Germany | 16/80 |

*Primary Examiner*—C. J. Husar
*Assistant Examiner*—Moshe I. Cohen
*Attorney, Agent, or Firm*—Blum, Kaplan, Friedman, Silberman & Beran

[57] ABSTRACT

A device for holding a door firmly closed includes a bracket for attachment to a door and a bistable assembly for attachment to the door jamb. A spring-biased piston within the bistable assembly presses one arm of a rotatable bell-crank against the tip of the bracket to hold the door firmly closed against the door jamb. Opening the door against the urging of the spring-biased piston rotates the bell crank to a standby position in which it is held stably by the spring-biased piston.

In a preferred embodiment, a solenoid within the housing of the bistable assembly rotates the bell crank from engaged position to standby position in response to an external signal, thereby moving the door away from the door jamb automatically.

6 Claims, 7 Drawing Figures

DEVICE FOR HOLDING A DOOR FIRMLY CLOSED

BACKGROUND OF THE INVENTION

There are a number of situations in which it is important that a door be held releasably but tightly closed against a door jamb. Such a situation is exemplified by large walk-in refrigerators in which case a poor seal between the door and the door jamb can result in substantial transfer of heat through the joint as well as in formation of ice which may interfere with opening and closing of the door. A further problem arises from the fact that individuals entering and leaving the refrigerator may be carrying loads of such weight and size that both hands of the individual are occupied, making it impossible to operate a latch manually.

A variety of devices have been devised for holding such doors firmly closed, but these have been less than completely satisfactory. These devices generally have a bistable feature in that the element responsible for holding the door closed can be moved between an engaged position and a standby position. However, such devices have not been able to provide the required reliability, long life and substantial closing force necessary where the door is large in size. In addition, such devices have not been adaptable to operation from an external signal. Such a signal can be provided by stepping on a mat, intercepting a light beam or pressing on a plate with a knee, for instance. It should be noted that the device need not open the door completely; it is only necessary that the door be opened sufficiently so that a foot can be inserted between the door and the door jamb, such a movement being sufficient for the individual to manage to open the door completely without use of the hands. As is evident, then, it would be desirable to provide a device which can hold a door closed firmly against a door jamb and which provides for either manual or electrical operation in opening the door.

SUMMARY OF THE INVENTION

A device in accordance with the present invention for firmly but releasably holding a door closed comprises a bracket mountable to a door and a bistable assembly to be affixed to a door jamb. The bistable assembly includes a housing, a hydraulic cylinder in said housing and a spring-biased piston within said cylinder. The exterior end of said piston is attached to the piston arm of a bell crank, the bell crank also having an engagement arm for engaging the tip of the bracket. The cylinder is pivoted to the housing so that it can rotate through the plane defined by the fulcrum of the bell crank and the pin mounting the cylinder to the housing. When the cylinder is on one side of said plane, the spring-biased piston pulls the bell crank in a direction such that the engagement arm of said bell crank engages the tip of the bracket for holding the door firmly closed. Opening the door rotates the bell crank against the urging of the spring-biased piston to a standby position in which the junction between the piston and the piston arm of the bell crank is on the other side of the fixed plane whereupon the spring-biased piston pulls the bell crank into a standby position against a stop mounted to the housing. Closing the door rotates the bell crank from standby position to engagement position and brings the engagement arm of the bell crank into engagement with the tip of the bracket, the spring-biased piston then urging the bracket in a direction such as to close the door firmly against the door jamb.

In a preferred embodiment a solenoid is provided in the housing, said solenoid being activatable by a signal from the exterior of said assembly. The solenoid is attached to the bell crank in such a way as to rotate same from engaged position to standby position in response to said external signal and bring the piston arm into engagement with said bracket tip for moving said door away from said door jamb, simultaneously bringing said bell crank to standby position.

Preferably, said bracket tip is provided with a loose pulley for minimizing friction between said bracket tip and said bell crank. Also, the fulcrum of said bell crank is preferably in the form of two coaxial sections with a gap therebetween traversable by said piston during rotation of said bell crank.

Accordingly, an object of the present invention is a device for holding a door firmly but releasably closed against a door jamb.

Another object of the present invention is a device of high reliability, long life and simple construction for holding a door closed firmly but releasably against a door jamb.

A further object of the present invention is a device for holding a door firmly but releasably closed against a door jamb which can be operated by an external electrical signal.

An important object of the present invention is a device for holding a door closed firmly but releasably against a door jamb wherein a substantial force can be exerted, thereby making said device suitable for use with large walk-in constructions such as refrigerators.

Still other objects and advantages of the invention will in part be obvious and will in part be apparent from the specification.

The invention accordingly comprises the features of construction, combinations of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
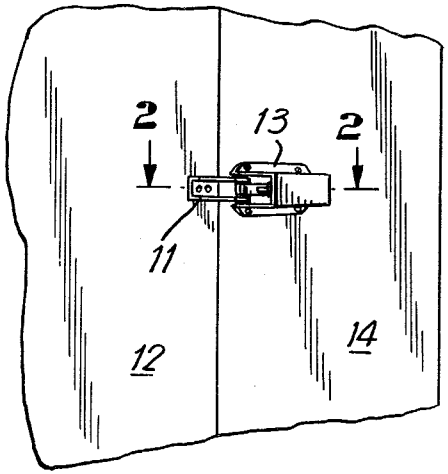
FIG. 1 is a perspective view of a device in accordance with the present invention as mounted on a door and door jamb.

Referring now to FIG. 1, a device in accordance with the present invention comprises a bracket 11 affixed to a door 12 and a bistable assembly 13 affixed to a door jamb 14. In the sectional view of FIG. 2 it can be seen that bistable assembly 13 includes a housing 16 inside which is a hydraulic cylinder 17 pivotably mounted to said housing by first pin 18, a bell crank 19 mounted pivotably to said housing by second pin 21 and a stop 22. Hydraulic cylinder 17 has fitted thereto a piston 23 joined rotatably to bell crank 19 by third pin 24. Cylinder 17 houses spring 26 which biases piston 23 inwardly of said cylinder, that is, for retracting piston 23, and a hydraulic fluid 27 for slowing the retraction of said piston during operation of the device.

Bell crank 19 has two arms, an engagement arm 28 for engaging tip 29 of bracket 11 to hold door 12 firmly closed against door jamb 14, and piston arm 31 pivotably attached to piston 23 by third pin 24.

Bracket 11 has a base 32 which can be securely affixed to door 12 and preferably includes a loose pulley 32' at tip 29 of said bracket for minimizing friction between said bell crank and said bracket.

Figure 2:
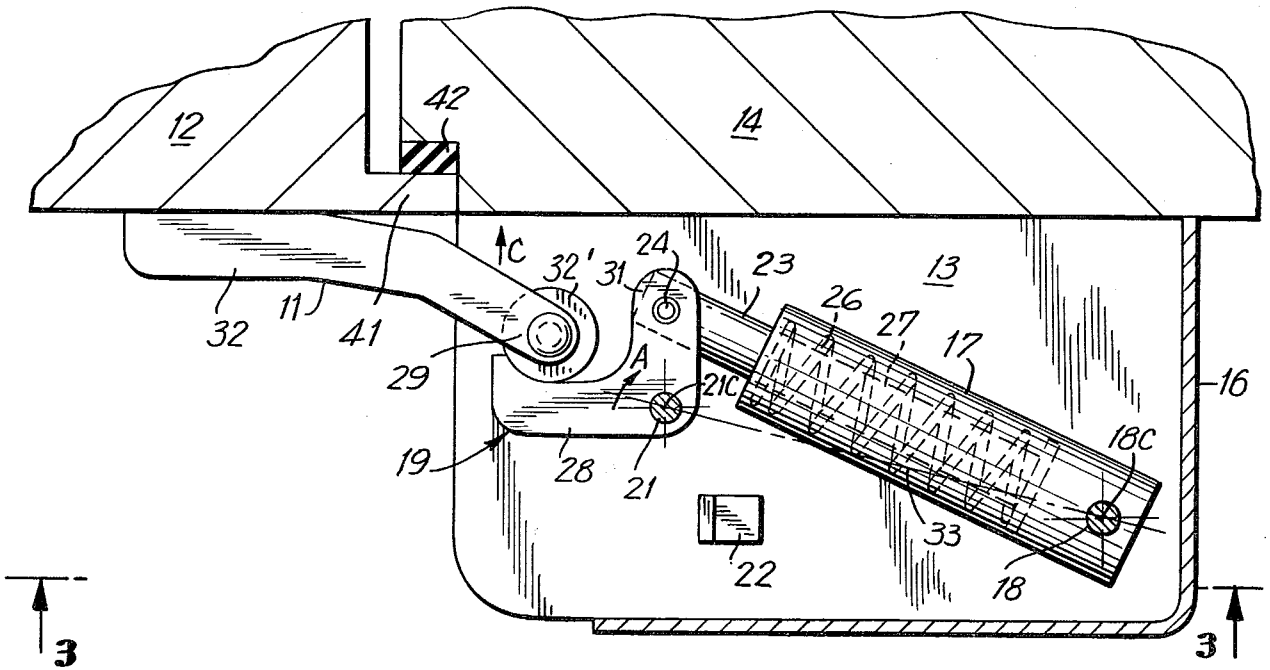
FIG. 2 is a view taken along line 2—2 of FIG. 1.
Figure 3:
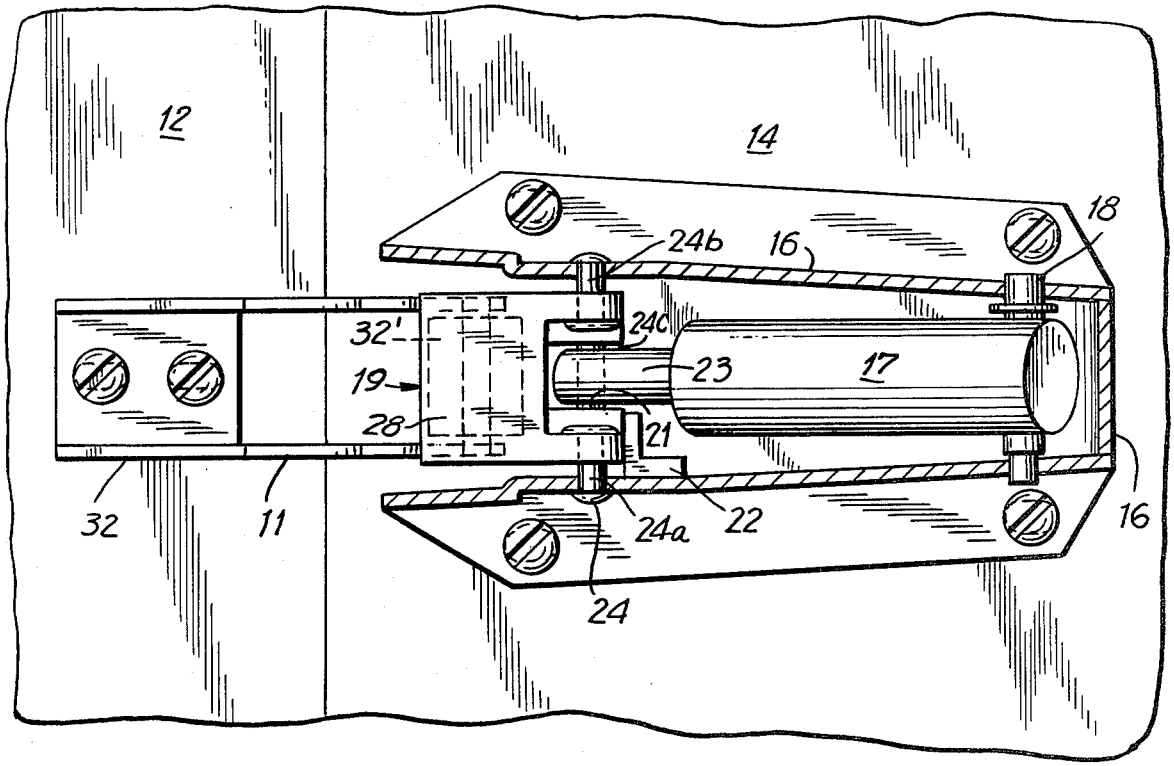
FIG. 3 is a view taken along line 3—3 of FIG. 2.
Figure 4:
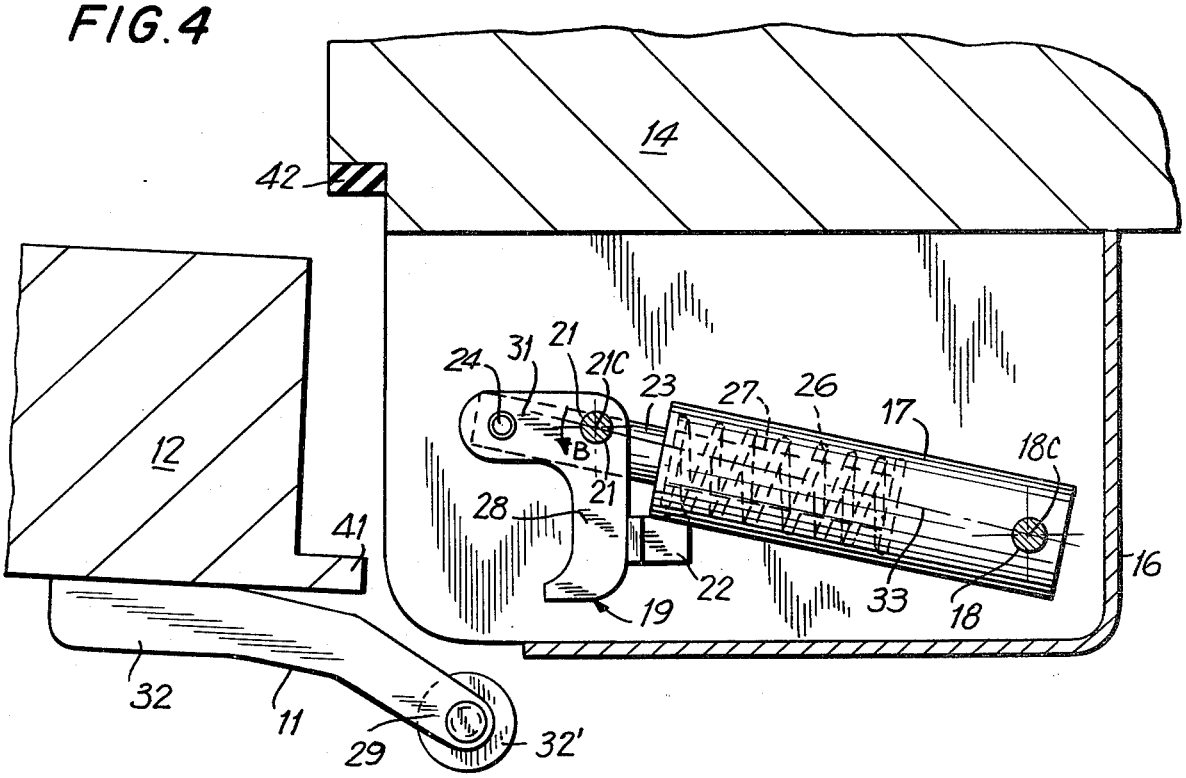
FIG. 4 is a view similar to that of FIG. 2 but showing the position of the components of the device when the door is opened.

In the view as shown in FIG. 2, the device is in engaged position. In more detail, spring 26 urges piston 23 inwardly of said cylinder, exerting a force on piston arm 31 such as to rotate bell crank 19 in the direction indicated by the arrow A, thereby forcing bracket 11 and door 12 in the direction indicated by the arrow C, so that the door 12 is held firmly but releasably against door jamb 14. The construction of the device is shown in an elevational sectional view in FIG. 3 which makes clear how said bracket and bistable assembly are affixed to said door and door jamb respectively. Also, FIG. 3 makes clear that pin 24 which joins piston 23 to piston arm 31 consists of two coaxial sections 24*a* and 24*b* with a gap 24*c* therebetween. Gap 24*c* provides for the rotation of cylinder 17 and piston 23 as bell crank 19 moves between a standby position and an engaging position. This requirement can be understood by comparison of FIG. 2 with FIG. 4. As will be clear from these Figures, first pin 18 has an axis 18C and second pin 21 has an axis 21C. The two axes define a plane 33, the edge of which is shown as a dashed line in FIGS. 2 and 4. As viewed in said Figures, when bell crank 28 is in engagement with tip 29 of the bracket 11, third pin 24 is above plane 33 and spring 26 operates to rotate bell crank 19 in the direction of arrow A. As viewed in FIG. 4, pin 24 has been moved to the other side of plane 33, piston 23 passing through the axis of second pin 21 in the process, so that spring 26 operates to rotate bell crank 19 in the direction indicated by arrow B and thus to hold said bell crank with engaging arm 28 in contact with stop 22. The initial rotation of bell crank 19 around pin 21 is caused by opening of door 12 by an individual about to pass through the doorway. Rotation of bell crank 28 in the direction of the arrow B is opposed by spring 26 until pin 24 reaches plane 33, at which point spring 26 serves to draw engaging arm 28 against stop 22. When the door is closed by an individual either inside or outside the door, tip 29 of bracket 11 is brought into contact with piston arm 31 rotating bell crank 19 in the direction of arrow A until pin 24 passes through plane 33. Spring 26 then rotates bell crank 28 in the arrow A direction bringing engagement arm 28 into engagement with tip 29 and closing door 12 firmly. Spring 26 thus supplements or replaces the effort of the operator of the door.

Figure 5:
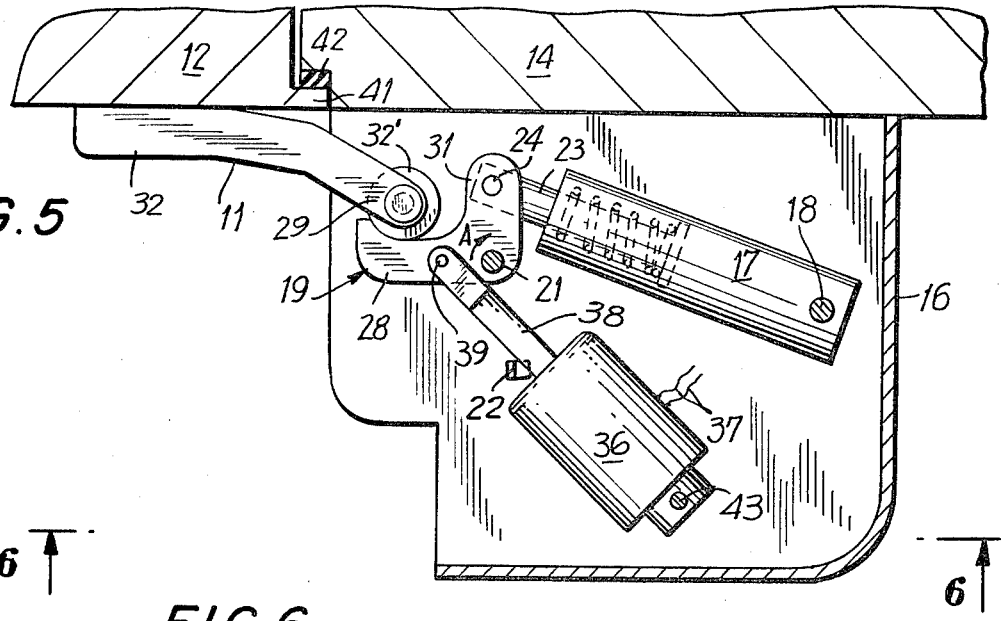
FIG. 5 is a sectional view of another embodiment of the invention as affixed to a door and a door jamb when said door is closed.

As aforenoted, it is frequently the case that the individual seeking to pass through the doorway is burdened so that neither hand is available for opening the door. In such case it is desirable that the door be openable in response to an electric signal generated in any of a variety of ways. The electric signal is transmitted to solenoid 36 (FIGS. 5–7) through wires 37 which lead to the exterior of housing 16. Solenoid 36 has a core 38 which is joined to engagement arm 28 of bell crank 19 by a fourth pin 39 so that when solenoid 36 is activated bell crank 19 is rotated away from the engagement position shown in FIG. 5 and in the direction indicated by arrow B. In the first stage of this rotation engagement arm 28 is separated from tip 29. Piston arm 31 then makes contact with tip 29 to move the door away from closed position and make it possible for an operator to complete opening of the door with a knee or foot. If bell crank 19 is large enough relative to the thickness of door 12, then operation of solenoid 36 can lead to opening of door 12 sufficiently so that a foot can be inserted between door 12 and door jamb 14. Where bell crank 19 is of smaller size, then provision of a lip such as that indicated by the reference numeral 41 can serve to make it possible to open the door with a knee or foot. Lip 41 is also useful for making contact with a gasket 42 mounted in the edge of door jam 14 to provide a tight seal therebetween.

Figure 7:
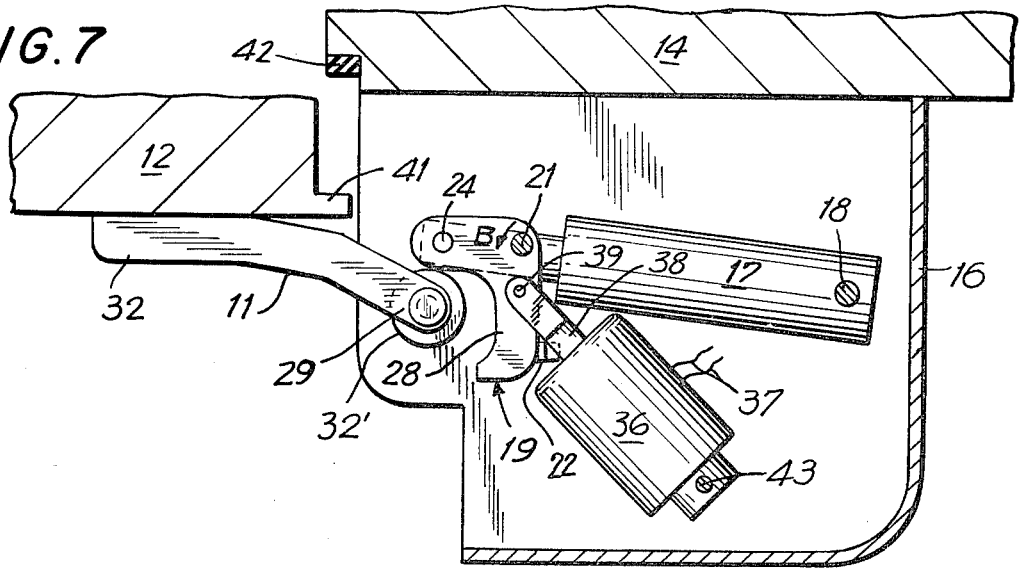
FIG. 7 is a sectional view similar to that of FIG. 5 but with the door opened.

A stop 22 is shown in FIG. 7, but this is not completely necessary since the seating of core 38 in solenoid 36 can also serve as a stop for limiting the excursion of bell crank 19.

Figure 6:
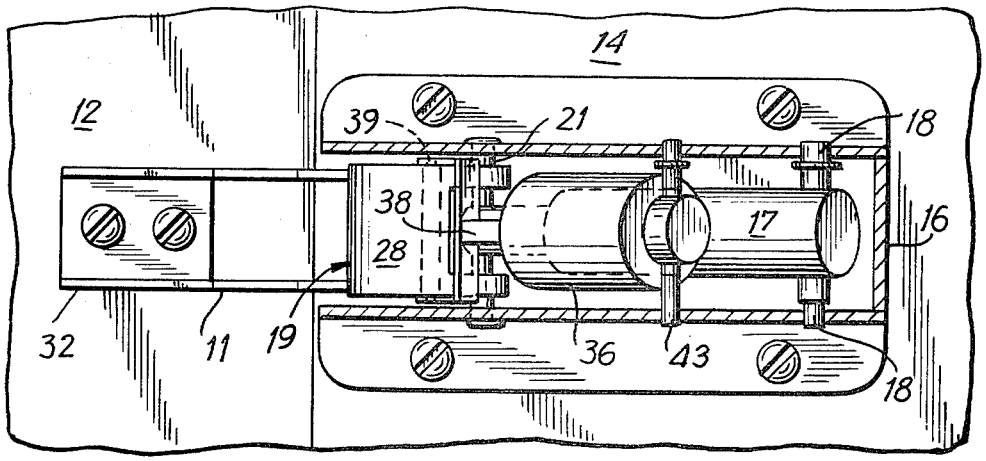
FIG. 6 is a view taken along line 6—6 of FIG. 5.

The positioning of solenoid 36 relative to hydraulic cylinder 17 is further exemplified in FIG. 6 which further illustrates the fact that pin 21 is constructed in two segments with a gap therebetween. Also, as can be seen, solenoid 36 pivots on a fifth pin 43 mounted to housing 16. Both first pin 18 and fifth pin 43 are trunion-like in the construction shown in FIGS. 5–7. A further point to be noted with this type of construction is that pins 18, 21 and 43 could be journaled at one end only thereof (not shown) to the housing, in which case it would not be necessary for pin 21 to be constructed in sections.

The closure device described herein is relatively simple in construction and therefore relatively low in cost. Moreover, it has been found to be extremely reliable and capable of a great number of cycles of opening and closing. Moreover, the second embodiment which responds to an external electrical signal greatly increases the usefulness of the device in that it is no longer necessary to provide human assistance to the user of the door when the user's hands are occupied with a load. Further, once provision is made for electrical activation of the device, it becomes economical to provide auxiliary services such as opening a vent for equalizing interior and exterior atmospheric pressure and turning on a light in the interior of the refrigerator. One of the most important advantages which accrues from electrical activation of the device stems from the fact that considerable effort may be required to open the door manually because opening the door causes a sudden decrease in the pressure within the chamber, and the resultant difference in pressure between the interior and exterior of the chamber increases the difficulty in opening the door. Electrical activation of the device provides the necessary force, and, moreover, the necessary force is decreased when a vent is opened simultaneously.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. Device for holding a door firmly but releasably closed against a door jamb, comprising a bracket mountable on said door and a bistable assembly mountable on said jamb for engagement with said bracket, said bracket having a base for mounting same to said door and a top projecting toward said assembly for engagement therewith, said assembly including an assembly housing, said housing containing a hydraulic cylinder and a piston and spring within said cylinder, said piston extending through one end of said cylinder, first pin means mounting said cylinder proximate the other end thereof to said housing for rotation about a first axis centered in said first pin means, a bell crank having a tip arm for engagement with said bracket tip in closing a door and a piston arm for making connection with said piston, second pin means mounting said bell crank proximate the junction of said arms to said housing for rotation about a second axis centered in said second pin means, third pin means pivotally joining the outer end of said piston arm with the outer end of said piston for mutual rotation around a third axis centered in said third pin means, said first and second axes defining a fixed plane, said spring biasing said piston inwardly of said cylinder and urging said third pin means toward said first pin means, said bell crank being rotatable between standby and engaged positions, said third pin means being on a first or second side of said plane when said bell crank is in said standby and engaged position respectively, and stop means engageable with said tip arm for defining said standby position of said bell crank and thereby of said cylinder and piston, said bistable assembly being so constructed and disposed relative to said bracket and tip of same that opening of said door rotates said bell crank from said engaged to said standby position and closing of said door rotates said bell crank from said standby position to said engaged position, thereby moving said third pin means from one side of said fixed plane to the other side thereof, said spring in combination with said piston and third pin means serving (1) to hold said bell crank releasably in whichever position to which said bell crank has been rotated by movement of said door and bracket tip; and (2) to press said door firmly against said jamb by engagement of said tip arm of said bell crank with said bracket tip, said hydraulic cylinder and said bell crank being so disposed relative to each other that the distance from said first pin means to said third pin means exceeds the distance from said first pin means to said second pin means at and between said standby and engaged position, whereby said piston must pass through the axis of said second pin means in moving between said standby and engaged positions.

2. The device as defined in claim 1, wherein said second pin means comprises two spaced-apart coaxial segments defining a gap therebetween for traversal thereof by said piston as said bell crank moves between said standby and engaged positions.

3. The device as defined in claim 1, further comprising a fluid within said cylinder for slowing movement of said piston within said cylinder.

4. The device as defined in claim 1, wherein said bracket includes a freely-rotatable wheel at the tip thereof for minimizing the friction of engagement of said tip with said arms of said bell crank.

5. The device as defined in claim 1, wherein said assembly further includes solenoid means within said housing, said solenoid means having a core and being activatable by an electric signal from the exterior of said assembly, and being connected with said bell crank for rotating same from said engaged position to said standby position on activation of same, said piston arm being so shaped and disposed as to engage said bracket tip for moving the door on which said bracket is mounted away from said door jamb.

6. The device as defined in claim 5, further comprising fourth pin means joining said core with said tip arm for mutual rotation relative to said fourth pin means and fifth pin means mounting said solenoid means rotatably to said housing.

* * * * *